United States Patent [19]

Hansen

[11] Patent Number: 4,623,073

[45] Date of Patent: Nov. 18, 1986

[54] DISPENSER FOR CARDS

[76] Inventor: Ernest E. Hansen, P.O. Box 272, San Juan Capistrano, Calif. 92693

[21] Appl. No.: 651,887

[22] Filed: Sep. 19, 1984

[51] Int. Cl.[4] ..... B65H 1/00

[52] U.S. Cl. ..... 221/45; 221/283; 221/312 R; 312/50; 271/161; 206/555

[58] Field of Search ..... 221/45, 63, 283, 282, 221/307, 309, 310, 312 R; 248/300, 247, 214, 218.4, 219.4, DIG. 11; 312/50, 60, 61; 271/161; 206/449, 555

[56] References Cited

U.S. PATENT DOCUMENTS

| | | | |
|---|---|---|---|
| 546,849 | 9/1895 | Hughes | 221/45 |
| 548,260 | 10/1895 | Lucas | 221/63 X |
| 688,179 | 12/1901 | Kerr et al. . | |
| 846,683 | 3/1907 | Moore | 221/309 X |
| 1,010,468 | 12/1911 | Weaver . | |
| 1,029,342 | 6/1912 | Bryant . | |
| 1,371,331 | 3/1921 | Swift . | |
| 1,379,228 | 5/1921 | Swift | 221/310 |
| 1,944,431 | 1/1934 | Hope et al. . | |
| 2,884,670 | 5/1959 | Garrison et al. | 248/300 X |
| 4,436,269 | 3/1984 | Dirksing et al. | 248/214 |

*Primary Examiner*—Joseph J. Rolla
*Assistant Examiner*—David H. Bollinger
*Attorney, Agent, or Firm*—Knobbe, Martens, Olson & Bear

[57] ABSTRACT

A card and pamphlet dispenser or vendor box comprising a rather flat vertically elongated box with a rearwardly sloping bottom wall spaced slightly from the rear wall of the box to define a transverse slot through which the cards or pamphlets may be withdrawn singly; the vendor box further comprises a mounting structure or hanger having a rear plate, a spacer plate, and two flanges which are adapted to engage a variety of common supports so that the box may be mounted from them.

9 Claims, 8 Drawing Figures

DISPENSER FOR CARDS

BACKGROUND OF THE INVENTION

Parties seeking to lease or purchase real estate are typically under significant time constraints. They are hindered in their efforts to quickly find a suitable piece of real estate by the necessity of meeting with the potentially large number of realtors representing owners in even a relatively small geographic area. Furthermore, it is difficult for these parties to keep track of the properties which they have inspected. A means of minimizing the number of time-consuming personal contacts between the realtor and the buyer and for providing the buyer with detailed record of the properties which the buyer has inspected is clearly necessary.

SUMMARY OF THE INVENTION

The present invention is a uniquely designed card and pamphlet dispenser or vendor box, which, though useful in other applications, is particularly adapted to dispense real estate information. The dispenser is designed to shelter cards or pamphlets from the elements, while providing convenient access to the cards and pamphlets through its bottom finger slot.

Because of its unique hanger, the vendor box can be hung from any one of a series of supports commonly used by realtors. The hanger forms a space with the box for receiving a horizontal support, such as as a tube of square cross-section. The vendor box is likewise adapted to be secured to three sides of a standard 4×4 post or hung from a bolt threaded through a standard angle iron stake. Finally, the vendor box's hanger is equipped with removable flanges which allow the vendor box to be attached to any smooth surface.

The vendor box has a rearwardly sloping bottom wall spaced slightly from the rear wall of the vendor box to define a transverse slot. At the bottom of this rear wall is a finger opening, which provides access to the cards, so that they may be pulled through the slot. The box's hanger acts to space the vendor box from the wall and shelter the finger slot from the elements. The box may be formed with ribs on its inside rear wall which urge the cards forward so that they engage the bottom wall forwardly from the transverse slot. This one card at a time into the slot. Preferably, the vendor box should be equipped with eye-catching written matter which describes the box's purpose and operation.

The cards, pamphlets, or other such elements dispensed by the vendor box may contain information, such as: the structure's floor plan; the sales price of the property; available financing; special features of the property; and the realtor to be contacted for a detailed inspection of the property. Use of the vendor box will allow parties to canvas a desirable location without regard to which realtor is listing which properties; only later, after narrowing the selection of properties to a reasonable number, needing to meet personally with the realtors.

Because the vendor box is constantly available to provide information concerning the property, realtors will be able to reach a larger portion of the market, while at the same time making more efficient use of their working hours by meeting with parties who are already informed and interested in the available property.

DETAILED DESCRIPTION OF THE PREFERRED EMBODIMENT

Figure 1:
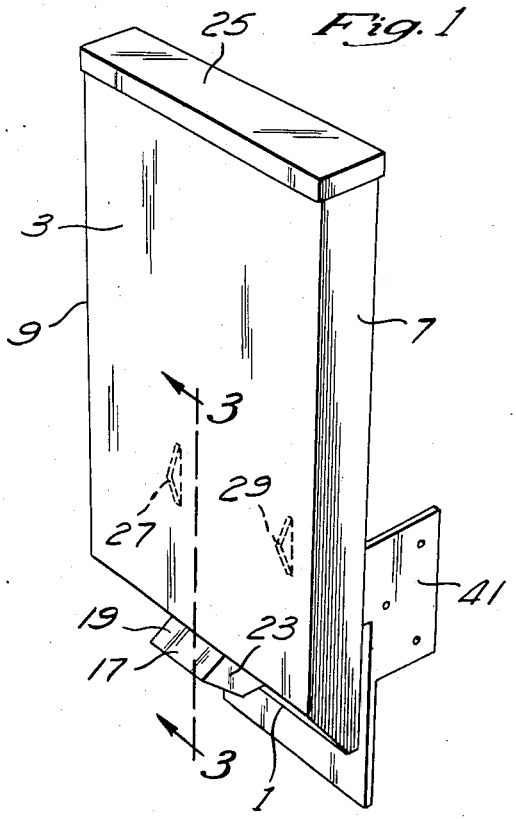
FIG. 1 is a perspective view of the front of the vendor box.

The vendor box shown in the drawing has a rather flat, vertically elongated shape with a slot along its lower rear edge that permits cards, pamphlets, or similar elements to be withdrawn from the box singly.

Figure 2:
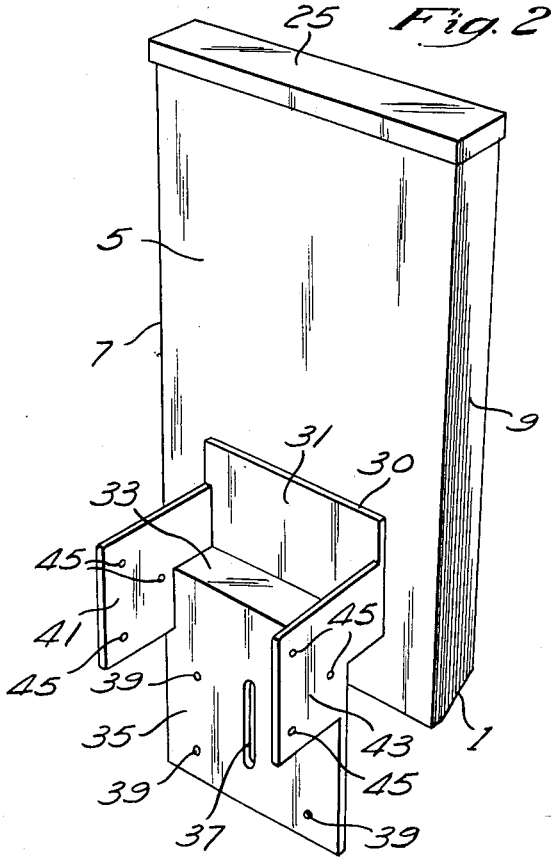
FIG. 2 is a perspective view of the rear of the vendor box.

Referring to FIGS. 1 and 2, the box has a bottom wall or panel 1 which is angled at about 45° from a shorter front wall 3 towards a longer rear wall 5. The rear edge of the bottom wall 1 is spaced slightly from the rear wall 5 to define a transverse slot 6. The front and rear walls are generally rectangular plates. The box further comprises a pair of plate-like side walls 7, 9 of generally tall, thin, rectangular shape but with an angular lower edge joining the angled wall 1. The shorter, vertical edges of the side walls 7, 9 are secured to the shorter front wall 3, and the longer vertical edges of the side walls 7, 9 are secured to the rear wall 5.

A centrally-located inverted U-shaped thumb opening 11 is formed in the box's lower bottom wall 1 and a centrally located inverted U-shaped finger opening 13 is formed in the box's rear wall 5 for a person to insert his thumb and finger through upon withdrawing a card or similar element 15 through the box's slot 6.

The thumb opening 11 in the bottom wall 1 of the box preferably has a hood 17 to prevent rain from entering the box through the thumb opening 11 and damaging the cards. The hood 17 has a rectangular-shaped front awning plate 19 secured to the bottom wall 1 proximate the lower edge of the front wall 3. The hood 17 has a pair of triangular side plates 21, 23 secured to the lower edge of the awning plate 19 and to the bottom wall 1.

The box is preferably protected by a horizontally elongate box-shaped cover 25 which fits over the upper portion of the box to protect the cards in the box from the elements. The cover may be secured by suitable screws.

Figure 3:
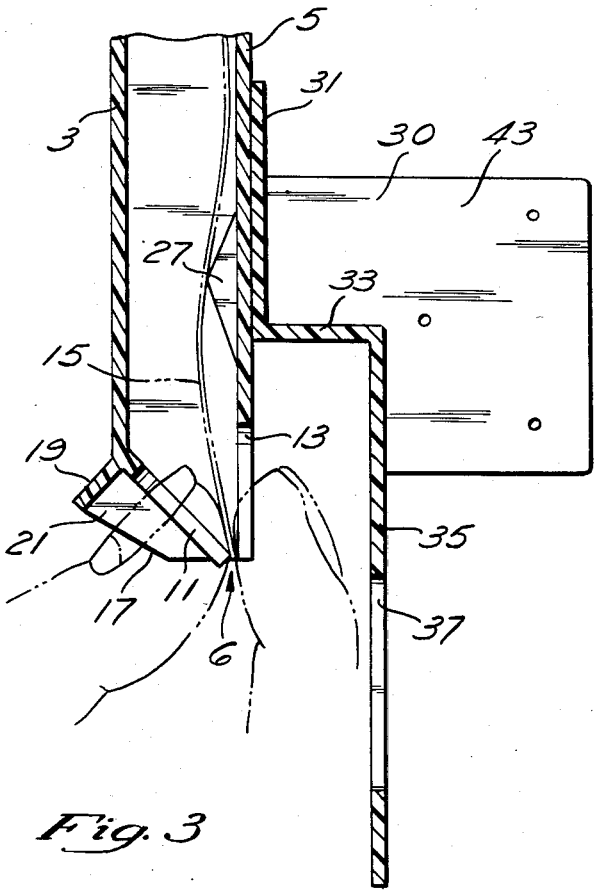
FIG. 3 is an enlarged partial sectional view taken along lines 3—3 of FIG. 1 showing the removal of an element from the vendor box.

Shown in FIG. 1, along the rear wall 5 of the box are a pair of triangularly-shaped, vertically-elongate guides, or ribs 27, 29. As illustrated by FIG. 3, these ribs 27, 29 serve to guide the element 15 to be dispensed from the box toward the forward portion of the box's rearwardly-sloping bottom wall 1. This causes the lower edges of the rear elements to be spaced forward slightly from the slot 6, thus fulfilling several functions: it makes it easier for one element 15 at a time be withdrawn through the slot; it prevents elements from inadvertently falling through the slot; and it prevents elements from being wedged in the slot.

Referring now to FIGS. 2 and 3, a mounting structure or hanger 30 is secured to the rear wall of the box. The hanger has a front plate 31 which is glued or otherwise securely attached to the rear wall 5 of the box, so that the entire face of the plate contacts wall. Secured both to the lower edge of the plate 31 and to the rear wall 5 of the box is a horizontal spacer plate 33 which spaces a rear vertical plate 35 from the hanger's front plate 31. The rear plate 35 is an approximately 4"×4" square plate with a centrally located, approximately ¼" wide, 1-½" tall vertical slot 37. On either side of the vertical slot are a pair of vertically-aligned bores 39. The rear plate 35 is perpendicular to the spacer plate 33, with its upper edge secured to the spacer plate 33 by glue or other suitable means.

As viewed in FIG. 2, the hanger has a left flange 41 and a right flange 43 which are vertically oriented and secured to the opposite side edges of the plates 31, 33, and 35. The flanges 41, 43 are located in parallel planes and are generally rectangular-shaped with a roughly 1" square corner section removed. The front vertical edge of each flange 41, 43 engages the rear face of the front plate 31, the horizontal cutout section edge engages the top face of the spacer plate 33, and the vertical edge of the cutout section engages the rear face of the rear plate 35. Each flange 41, 43 contains a set of three triangularly-spaced bores 45.

As illustrated in FIG. 3, the user inserts a forefinger into the opening 13 in the rear wall 5 of the box, access to which is facilitated by means of the space between the rear wall 5 of the box and the rear plate 35 of the hanger, inserts a thumb into the opening 11 in the bottom wall 1 of the box, pinches the element 15 between the thumb and forefinger, and pulls the element 15 down through the horizontal, transverse slot in the bottom of the box.

Figure 4:
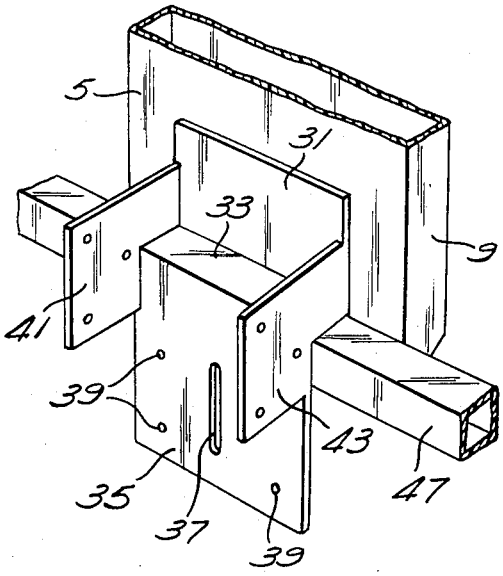
FIG. 4 is a partial perspective view showing the vendor box hung on a horizontal tubing.

As shown in FIG. 4, the vendor box may be hung by a horizontal tubing 47 of square cross-section or other comparable support. When the vendor box is suspended in this manner, the rear face of the rear wall 5 of the box lies flush against the front vertical face of the tubing 47. The bottom face of the spacer plate 33 is supported by the top horizontal face of the tubing 47, and the front face of the rear plate 35 contacts and retains the rear vertical face of the tubing 47. In this manner, the vendor box may be securely hung from standard realty signs which incorporate a horizontal tube of square cross-section in their design.

Figure 5:
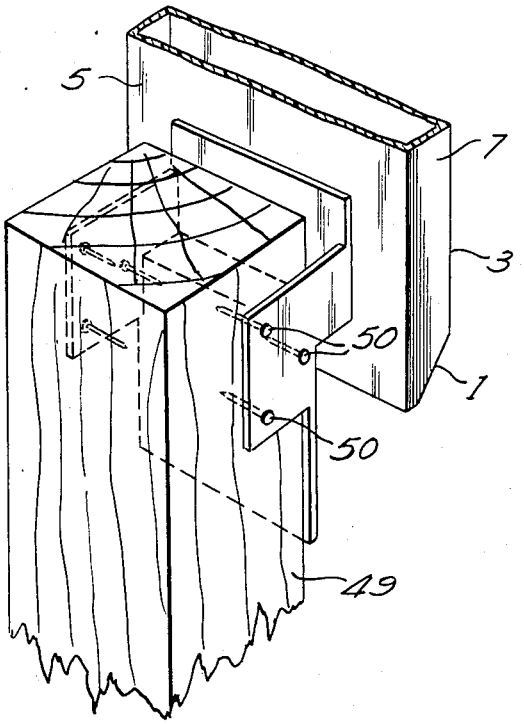
FIG. 5 is a partial perspective view showing the vendor box attached to a standard 4″×4″ post.

In FIG. 5, the vendor box is shown hung from a standard 4×4 post 49. When suspended in this manner, the rear face of the rear plate 35 lies flush against the central face of the post 49. The right face of the left flange 43 lies flush against the left face of the post 49 and is secured thereto by three fasteners 50, such as nails or screws, which may be inserted through the bores 45. The left face of the right flange 41 lies flush against the right face of the post 49 and is secured thereto by three fasteners 50, such as nails, which may be inserted through the three triangularly-spaced bores 45. In this manner, the vendor box may be securely hung from retail signs which incorporate a 4×4 post in their design.

Figure 6:
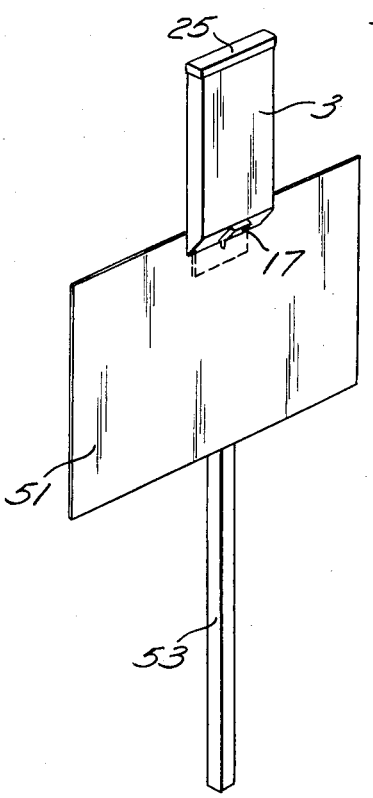
FIG. 6 is a front perspective view of the vendor box attached to an angle iron stake by a bolt.
Figure 7:
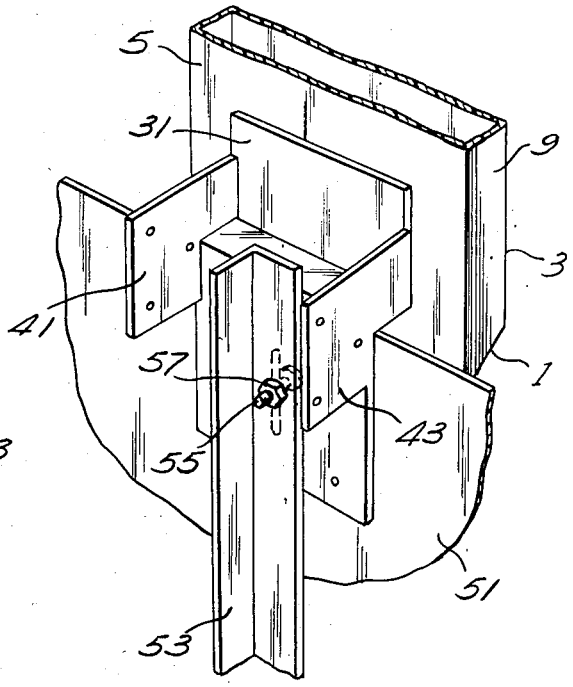
FIG. 7 is an enlarged partial rear perspective view showing the vendor box and stake of FIG. 6.

As illustrated in FIG. 6, the vendor box may also be hung from a retail sign 51 which incorporates an angle iron 53. In signs of this design, the sign 51 itself is secured to the angle iron 53 by a number of bolts 55, as seen in FIG. 7. Generally, the vendor box may be suspended from one of these existing bolts 55. The vendor box is hung by inserting the rear plate 35 of the hanger between the angle iron 53 and the sign 51 so that the front face of the rear plate 35 is flush against the back of the sign 51, and the rear face of the rear plate 35 is flush against the angle iron 53. A bolt 55 is then inserted through an aperture in the sign 51 through the slot 37 in the rear plate 35 of the hanger and through an aperture in the angle iron 53. The bolt 55 is then secured to the angle iron 53 by means of a fastener 57 such as a nut.

Figure 8:
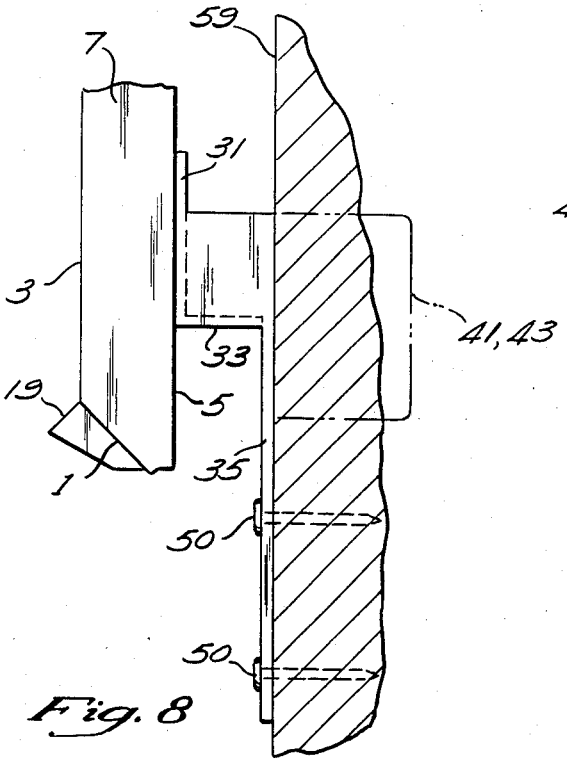
FIG. 8 is a partial sectional view illustrating the vendor box attached to a vertical support surface.

FIG. 8 illustrates the vendor box as it would appear when it is attached to a flat surface 59. The flanges 41, 43, shown in phantom, are cut away from the hanger. When hung in this manner, the rear face of the rear plate 35, lies flush against the flat surface 59 and is secured thereto by fasteners 50, such as nails.

As can be seen from FIGS. 4–8, the spacer plate 33 of the hanger facilitates access to the finger opening 13 in the rear wall 5 of the box regardless of the support utilized to hang the box. Furthermore, it can be seen that the hood 17 is so orientated, regardless of the manner in which the box is hung, as to shield the elements 15 contained in the box from rain or snow. Thus, regardless of the weather or time of day, the vendor box is available to dispense the elements contained and protected therein to interested parties.

I claim:

1. A vendor box adapted to dispense vertically oriented cards, pamphlets or other such items, said box comprising:

a first vertical wall having a bottom edge;

a second vertical wall spaced from said first vertical wall and having a bottom edge;

a pair of side walls extending between said vertical walls;

a sloping bottom wall extending between the bottom edges of said vertical walls, said first vertical wall having a bottom edge lower than said second vertical wall;

a transverse slot formed adjacent the bottom edge of said first vertical wall through which said elements are individually dispensed, said slot having first and second opposing edges, said first edge being closer to said second vertical wall than said second edge;

a guide protruding from the inside surface of the first wall, towards the second wall a distance further than the amount by which the first edge of the slot is spaced from the inside surface of the first wall, said guide protruding from the first wall at a location spaced upwardly from said bottom edge;

said guide and said bottom wall being adapted to impart a curve to any vertically oriented cards, pamphlets, or other items located within the box to facilitate the removal of said cards, pamphlets or other items through said slot on an individual basis.

2. The vendor box of claim 1 wherein said first wall forms a rear wall of said box, and said second wall forms a front wall of said box.

3. The vendor box of claim 1 wherein said guide is substantially triangular in shape, and the apex of said triangle protrudes from said first wall.

4. The vendor box of claim 1 wherein said first wall is spaced from said bottom wall to form said slot.

5. The vendor box of claim 1 wherein a finger opening is provided above the bottom edge of said first wall, and a finger opening is provided on the bottom wall, adjacent the slot, so that said elements within said box can be manipulated from outside of the box.

6. The vendor box of claim 5, further comprising:

a hanger for attaching said box to a variety of supports, said hanger acting to space said box from a support so as to provide room for a finger to be inserted into said first wall finger opening, said hanger comprising a horizontal spacer plate extending normal to said first wall, and a vertical rear plate positioned parallel to first first wall and depending from spacer plate; the bottom of said spacer plate, the front of said rear plate, and said first wall forming a space in which a horizontally oriented support for said box may be retained, said spacer plate being located sufficiently above said first wall finger opening so that said spacer plate is capable of resting on and being supported by a horizontal support while at the same time leaving the finger opening unblocked, said hanger further comprising two spaced, vertically oriented flanges extending rearwardly from said rear plate, said flanges being oriented parallel to one another and normal to said rear plate and said first wall, said rear plate and said flanges defining a space in which a vertically oriented support for said box may be retained, so that three sides of a vertical support would be surrounded.

7. A vendor box adapted to dispense vertically oriented cards, pamphlets, or other such items, comprising:

a box having a front wall, a rear wall, side walls, and a bottom wall which slopes downwardly from front to back;

a transverse slot formed adjacent the lower edge of said rear wall through which said cards, pamphlets or other items may be singly removed;

a finger opening at the bottom of said rear wall to facilitate manipulation of said cards, pamphlets, or other such items; and a hanger for attaching said box to a variety of supports, said hanger acting to space said box from a support so as to provide room for a finger to be inserted into said finger opening, said hanger comprising a horizontal spacer plate extending normal to said rear wall, and a vertical rear plate positioned parallel to said rear wall and depending from spacer plate; the bottom of said spacer plate, the front of said rear plate, and said rear wall forming a space in which a horizontally oriented support for said box may be retained, said spacer plate being located sufficiently above said finger opening so that said spacer plate is capable of resting on and being supported by a horizontal support while at the same time leaving the finger opening unblocked, said hanger further comprising two spaced, vertically oriented flanges extending rearwardly from said rear plate, said flanges being oriented parallel to one another and normal to said rear plate and said rear wall, said rear plate and said flanges defining a space in which a vertically oriented support for said box may be retained, so that three sides of a vertical support would be surrounded.

8. The vendor box of claim 7 wherein said vertical plate has aperture through which a bolt may be inserted so as to hang said box from a support.

9. The vendor box of claim 7 wherein said flanges are removable so that said rear plate may directly abut and be secured to a flat vertical surface.

* * * * *